United States Patent [19]

Kalocsai

[11] Patent Number: 4,684,404

[45] Date of Patent: Aug. 4, 1987

[54] DISSOLUTION OF NOBLE METALS

[75] Inventor: Guy I. Z. Kalocsai, Armidale, Australia

[73] Assignee: Kaljas Pty. Limited, North Sydney, Australia

[21] Appl. No.: 784,463

[22] Filed: Oct. 4, 1985

Related U.S. Application Data

[63] Continuation of Ser. No. 628,371, Jul. 6, 1984, abandoned.

[30] Foreign Application Priority Data

Jul. 8, 1983 [AU] Australia ..... PG0202

[51] Int. Cl.[4] ..... C01G 7/00; C22B 11/04

[52] U.S. Cl. ..... 75/118 R; 252/187.2; 436/26; 423/38; 423/80

[58] Field of Search ..... 423/38; 252/186.1, 186.43, 252/187.1, 187.2, 182; 436/80, 177, 178, 26; 75/118 R

[56] References Cited

U.S. PATENT DOCUMENTS

| | | | |
|---|---|---|---|
| 267,723 | 11/1882 | Schaeffer . | |
| 716,847 | 12/1902 | Martino | 423/38 X |
| 732,709 | 7/1903 | Cassel | 423/38 X |
| 861,535 | 7/1907 | Pritchard . | |
| 1,041,407 | 10/1912 | Baxeres | 423/38 |
| 2,283,198 | 5/1942 | Fink et al. . | |
| 2,304,823 | 12/1942 | Harrison . | |
| 2,457,480 | 12/1948 | Lewis | 252/187.2 X |
| 3,397,040 | 8/1968 | Lakin et al. . | |
| 3,495,976 | 2/1970 | Bazilevsky et al. | 423/38 X |
| 3,547,573 | 12/1970 | Tourdot et al. | 252/187.2 X |
| 3,558,503 | 1/1971 | Goodenough et al. | 252/187.2 |
| 3,625,674 | 12/1971 | Jacobs . | |
| 3,709,681 | 1/1973 | Wilson . | |
| 3,764,650 | 10/1973 | Scheiner et al. | 423/38 |
| 3,778,252 | 12/1973 | Wilson . | |
| 3,886,081 | 5/1975 | Ceska | 252/187.2 X |
| 3,957,505 | 5/1976 | Homick et al. | 423/38 X |
| 4,190,489 | 2/1980 | Bahl et al. | 423/38 X |
| 4,260,451 | 4/1981 | Schmeckenbecher | 423/38 X |
| 4,382,799 | 5/1983 | Davis et al. | 252/187.2 X |
| 4,389,248 | 6/1983 | Iio et al. . | |
| 4,397,690 | 8/1983 | Vanderpool et al. | 423/38 X |

FOREIGN PATENT DOCUMENTS

| | | | |
|---|---|---|---|
| 11817 | of 1886 | United Kingdom . | |
| 696036 | 11/1979 | U.S.S.R. | 252/187.2 |

OTHER PUBLICATIONS

Wise, E. W. (Ed.) *Gold, Recovery, Properties and Applications,* Van Nostrand Co. Inc. Princeton, NJ (1964) p. 49.

*McGraw-Hill Encyclopedia of Science & Technology,* (1982), vol. 12, p. 155.

"Chlorine as a Solvent in Gold Hydrometallurgy", G. L. Putnam, 145(3) 70–73 (1944) *Engineering and Mining Journal.*

*Primary Examiner*—Michael S. Marcus

*Attorney, Agent, or Firm*—Nixon & Vanderhye

[57] ABSTRACT

The invention provides a reagent suitable for the dissolution of metallic gold and various methods for the application of the reagent including gold analysis, gold extraction, gold separation and the in-situ treatment of gold deposits.

The reagent uses a protic solvent containing a preferably non-reducing cation source and a source of bromine optionally in combination with a strong oxidizing agent. The protic solvent is water or a lower alkyl alcohol or a mixture thereof. The cation source preferably highly dissociates in the protic solvent and suitable cation sources include dibasic ammonium phosphate, ammonium sulphate, potassium chromate, hydrochloric acid, sodium hydroxide and potassium hydroxide. Cation sources which liberate ammonium cations are preferred.

The strong oxidizing agent should by highly dissociated in the solvent and is preferably selected from the group consisting of hydrogen peroxide, sodium peroxide, potassium peroxide, sodium permanganate, potassium permanganate, potassium dichromate and ferric sulphate.

19 Claims, 1 Drawing Figure

DISSOLUTION OF NOBLE METALS

Figure 1:
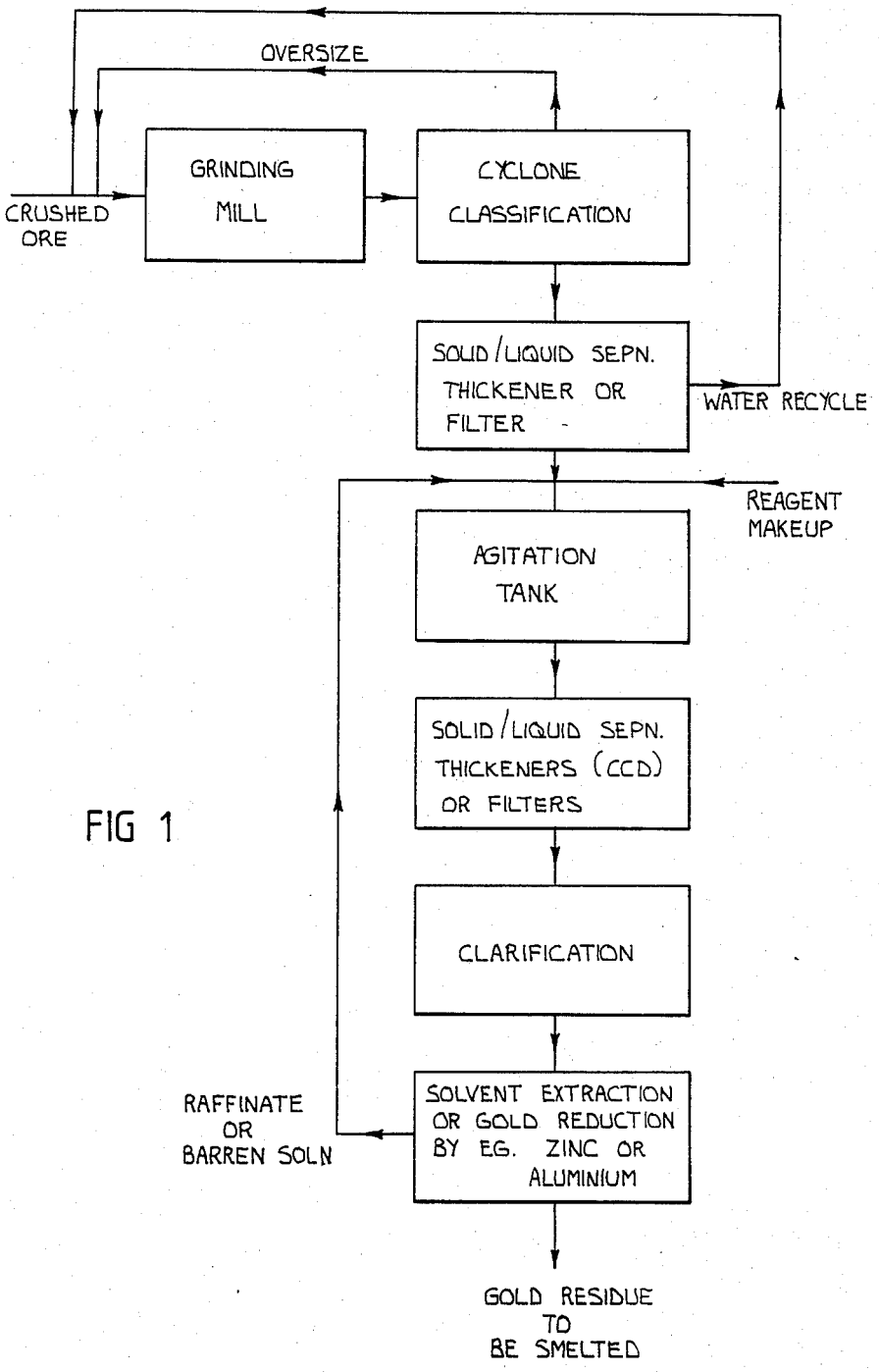

This is a continuation of application Ser. No. 628,371, filed July 6, 1984, now abandoned.

The present invention relates generally to the dissolution of noble metals. In particular the invention relates to a reagent suitable for the dissolution of metallic gold and to various applications thereof including the analysis of gold, the extraction of gold from its ores, the separation of gold from other noble metals and the treatment of gold deposits.

Gold is widely recognised as being a most difficult metal to dissolve. It has long been known that metallic gold can be dissolved by reagents such as aqua regia, thiourea, thiosulphates and acid chloride systems. It has also long been known that gold can be taken into aqueous solution and thereby "dissolved" by the formation of a water soluble complex in dilute aqueous cyanide solutions such as aqueous sodium cyanide and aqueous potassium cyanide. Such prior art techniques, however, suffer from substantial disadvantages. For example, thiourea and thiosulphate are subject to oxidative degradation and are thus prone to high consumption levels in extracting gold from its ores. Aqua regia is expensive, extremely corrosive, it,readily dissolves base metals and dissolves gold relatively slowly in aqueous solution. Acid chloride systems also suffer from some of these disadvantages and are slow to dissolve gold. Forming a soluble cyanide complex is one of the less costly methods known for dissolving gold but the reaction is again rather slow. A further disadvantage is that the majority of these gold solvents are constrained in their use to either an acid or alkaline media. In addition, the use of a cyanide solution is frequently considered environmentally unacceptable.

It is an object of the present invention to provide in one embodiment, a reagent suitable for the dissolution of metallic gold. It is a further object of the invention to provide, in another embodiment, a method for the extraction of gold from its ore. It is a still further object of the invention to provide in still further embodiments a method for the in-situ treatment of gold deposits, a method for the separation of gold from other noble metals or from other gold containing materials and a method for the quantitative analysis of gold ores and other gold-containing materials.

The present invention provides in one embodiment a reagent for the dissolution of metallic gold comprising a protic solvent containing (a) a cation source comprising one or more compounds which liberate cations in solution in said solvent and (b) a halogen source (as herein defined) capable of liberating free bromine in solution in said solvent.

The reagent preferably has a substantially neutral pH and most preferably a pH in the range of from 6.5 to 8.5.

The protic solvent is selected from the group consisting of water, lower alkyl alcohols including methanol and ethanol and mixtures thereof. Water or mixed solvents in which water is the major component are preferred for use as the protic solvent in accordance with the present invention. For reasons of economy and availability, water is the most preferred solvent in practice.

The cation source may be any source which in the protic solvent provides a source of cations. Preferably the cation source is non-reducing in character and/or a compound which highly dissociates in the protic solvent. Where an atom or radical such as $Fe^-$ is capable of providing cations having different oxidation states e.g. $Fe^{2+}$, $Fe^{3+}$ the cation having the lowest stable oxidation state for that atom or radical e.g. $Fe^{2+}$ is preferred for use in accordance with the invention. It has also been found that cation sources which dissociate to an appreciable extent in the solvent to form a plurality of cations such as dibasic ammonium phosphate, ammonium sulphate and potassium chromate are particularly suitable for use as the cation source in accordance with the present invention and compounds which yield an ammonium cation in the protic solvent are most preferred.

It has further been found that strong acids and bases which are highly dissociated in aqueous media such as hydrochloric acid, sodium hydroxide and potassium hydroxide may act as a cation source in accordance with the invention. However, such compounds may react with other metals present in a given sample. For example should HCl be used as a cation source it would react with base metals in the gold ore being treated. Such a reaction may be useful as a pretreatment step but may also interfere with the complexing reaction. Therefore following such pretreatment the pH may conveniently be adjusted to between 6.5 and 7.5 prior to introduction of a halogen source according to the present invention. As can therefore be appreciated particular care should be taken to consider the possible interference from such side reactions when the cation source contains a strong acid or strong base.

The term "halogen source" as used herein means elemental bromine in solid, liquid or gaseous form and any mixture, solution or compound which yields free bromine in the presence of gold and the other components of the reagent. Elemental bromine may be introduced into the reagent in gaseous form. It may also be introduced in liquid form, for example, as bromine liquid or bromine water. It is also within the scope of the invention for the halogen source to be introduced in the form of a compound capable of liberating bromine in the presence of gold and the other components of the reagent. A halogen source which acts as a strong oxidizing agent and has increased solubility in the protic solvent in the presence of the cation source is particularly preferred for use in accordance with the invention.

The halogen source preferably acts as a source of nascent bromine. Preferred halogen sources include inorganic or organic bromine containing compounds from which bromine can be liberated in the reagent.

The reagent provided by the present invention may optionally include a strong oxidizing agent. The oxidizing agent should be highly dissociated in the protic solvent. Preferably the oxidizing agent is selected from the group consisting of the peroxides including hydrogen peroxide, sodium peroxide and potassium peroxide and the permanganates including sodium permanganate and potassium permanganate. It has been found that the presence of a strong oxidizing agent maintains the activity of the reagent over a longer period. Thus addition of a strong oxidizing agent may be desired even in cases where the dissolution rate would be thereby reduced. It has been found however that the dissolution rate in the presence of a strong oxidizing agent may be increased by adjusting the pH to a substantially neutral level, preferably in the range of from 6.5 to 7.5 and most preferably about 7.0.

As can be appreciated from the above, a wide variety of compounds can be used as the cation source in accordance with the invention and it may even be that the cation source also acts as an oxidizing agent. Particularly preferred examples of such compounds are potassium permanganate, potassium dichromate, ferric sulphate and sodium peroxide.

Use of a reagent according to the invention facilitates the formation of the highly water soluble salts of hydrobromoauric acid. Such salts may be represented by the general formula:

$$MAuBr_4.nH_2O \quad (I)$$

where

M is a cation n is 0 or an integer.

Particularly preferred compounds according to general Formula (I) are those which exhibit high solubility in aqueous media including the following:

$NH_4AuBr_4$ $NaAuBr_4.2H_2O$ $KAuBr_4.2H_2O$ $RbAuBr_4$ $CsAuBr_4$

Accordingly, cation sources which promote the formation of such salts are preferred for use in accordance with the invention.

A particularly preferred reagent comprises an aqueous solution of elemental bromine, NaCl and NaOH. This particularly preferred reagent has the advantages of being economical to prepare, provides a source of $Na^+$ ions in solution, the presence of NaCl and particularly NaOH increases the solubility of liquid bromine in aqueous solution and promotes the formation of nascent active bromine. The function of NaCl in this particularly preferred reagent is to provide a source of cations ($Na^+$). The choice of NaCl over other possible sources of cations is largely economic and is not due to the presence of $Cl^-$ anions. It has been found that with the exception of bromine containing anions such as $Br^-$ or $BrO_3^-$ the nature of the anion present does not significantly affect the dissolution rate according to the invention.

This particularly preferred reagent provides a means for the rapid dissolution of metallic gold at ambient temperatues in both acid and alkaline environments. In many gold ores encountered in mining e.g. the ore from the Telfer Mine in North West Australia, the preferred reagent provides selective dissolution of gold i.e. will not take more than trace quantities of base metal sulphides into solution. The preferred reagent also provides a pregnant solution particularly suitable for recovery of the gold by known solvent extraction and carbon-in-pulp procedures. In addition to the above the reagent combination is very practical in that it is relatively straight forward to prepare, operates in aqueous solution and the bromine can be recycled. The process effluents obtained from use of the particularly preferred reagent are essentially non-toxic chlorides and bromides in dilute aqueous solution. Their relatively non-toxic nature is demonstrated by the fact that sodium, potassium and ammonium bromides were widely used as sedatives prior to the introduction of barbiturates and potassium bromide is used in agriculture for preserving vegetables and fruit.

It has been found that the gold dissolution reagent provided by the invention readily dissolves metallic gold at ambient temperatures. In view of the speed of dissolution at ambient temperatures, no external heating is necessary although it has been found that the speed of the dissolution reaction increases appreciably with an increase in ambient temperatures. For example it has been observed that a 20° C. increase in reaction temperature can result in an increase in dissolution rate of the order of 300% in acidic medium and of the order of 50% in alkaline medium. Preferably the method provided by the present invention is employed at temperatures in the range of from 10° C. to 45° C.

When a reagent as provided by the invention is to be employed in hot climates an alkaline medium is particularly preferred as less loss of bromine is likely to occur than with in acidic medium at elevated temperatures.

It has further been found that when the halogen source is in combination with a source of sodium cations the reagent provided by the invention is relatively specific in that it dissolves gold but does not dissolve other noble metals such as silver or platinum.

It has also been found that the reagent provided by the invention may to some extent attack and dissolve metals in pure form such as aluminum, lead and iron but will not readily attack compounds containing such elements. It is accordingly recommended that contact between the reagent and metals in their pure form is avoided. Therefore, reaction vessels and other equipment or apparatus which may come into contact with the reagent provided by the invention is preferably protected against attack. This may be effectively and economically achieved by application of a suitable plastics based surface coating to exposed metallic parts liable to corrosion. The rate of such corrosion is reduced by use of a reagent according to the invention which is alkaline or substantially neutral.

After the gold is taken into solution using a reagent as provided by the invention, the gold may be recovered from solution by a number of methods already known to those skilled in the art for recovering gold cyanide complexes. Such techniques include solvent extraction using organic solvents for the complex including methyl isobutylketone, (MIBK) di-isobutyl ketone (DIBK) and ethyl ether. The metallic gold can be recovered from the solvent by distillation or reduction. It has been found that gold/bromine complexes formed according to the invention are particularly suitable for extraction from the pregnant liquor with MIBK or DIBK.

Other known recovery techniques include the introduction of a reducing agent to the pregnant liquor. Examples of such techniques are zinc and aluminium precipitation whereby the metallic dust is introduced into the solution to precipitate metallic gold by displacement. Other known recovery techniques suitable for use in recovering gold from the pregnant liquor include electrodeposition, carbon adsorption, and ion exchange. The recently developed carbon-in-pulp recovery method is particularly suitable for use in recovery of gold extracted in accordance with the present invention.

The reagent provided by the invention may be prepared in-situ at the treatment site or at a location remote from the treatment site. In the latter case care should be taken to avoid the escape of halogen vapour from the reagent preferably by storage of prepared reagent in sealed containers.

A reagent according to the invention may be prepared relatively simply by mixing the components thereof in the solvent. In a particular example the selected cation source is dissolved in the selected protic solvent. Generally the concentration of cation source is not more than 20 wt. % and preferably in the region of 1–10 wt. %. When addition of oxidizing agent is required, the oxidizing agent is preferably added to the solvent either immediately after or at the same time as the cation source. Preferably the concentration of oxidizing agent present in the final reagent is not higher than the concentration of the cation source. Typically the concentration of the oxidizing agent in the reagent is of the order of 1% w/v. Preferably the pH is then adjusted so that after the addition of the halogen source and mixing the reagent with the material being treated, the final pH is preferably slightly alkaline, and most preferably about 7.5. Finally the halogen source is added. Preferably the halogen source provides a bromine concentration in the final reagent of not more than 5 wt. %. Typically the bromine concentration in the reagent is in the range of 0.3 to 3.0 wt. %. (approximately equivalent to 0.1%–1.0% v/v of liquid Br).

The application of the reagent provided by the invention to the commercial extraction of gold from its ore is compatible with known extraction techniques.

Typically the technique applied to a particular ore body varies with the characteristics of the ore and optimization testing is required in order to select an appropriate flow sheet and operating parameters.

To illustrate the compatibility of the use of the reagent provided by the invention with conventional extraction techniques a postulated flow sheet for an agitation leach extraction scheme is provided by FIG. 1.

A preferred embodiment of the application of the invention to extraction of gold from its ore by an agitation leaching technique will now be described with reference to FIG. 1. As indicated in FIG. 1, the ore is comminuted to a fine mesh size to facilitate contact between the metallic gold and the reagent. The degree of comminution depends primarily upon the coarseness of gold in the ore and will vary according to ore type. Typically such a mesh size would be of the order of 150–200.

Following comminution the ore slurry undergoes dewatering or thickening. The ore slurry is then transported to the agitation leaching tank where the reagent provided by the present invention is added. The concentration of the added reagent may be substantially higher than that desired during the leaching phase to take into account the moisture which will already be present with the ore.

The conditions of agitation, and particularly the length of agitation, will depend largely upon the anticipated time for complete dissolution of the gold. Typically the gold would be expected to be dissolved in less than two hours and most preferably the reaction time is likely to be between ½ hour and one hour.

Following agitation leaching the contents of the agitation tank are passed to the solid liquid separation stage at which separation is undertaken by currently practised methods including countercurrent decantation thickeners and filtration. In an alternative arrangement not shown in FIG. 1 the contents of the agitation leach tank may be subjected to a carbon-in-pulp recovery process to recover the gold from the leach solution.

In the example process illustrated in FIG. 1, the agitation leach stage is followed by clarification and recovery of the dissolved gold from solution such as by solvent extraction with MIBK or DIBK. Following evaporation and distillation or reduction the raffinate from the solvent extraction is recycled and the gold residue passed to the smelter for further processing.

As will be appreciated by those skilled in the art, due to the volatility of the halogen component of the reagent of the invention, the agitation leach phase should preferably be a mechanical agitation and not agitation by aeration. Similarly, for reasons of economy and industrial hygiene, it is preferred that the agitation stage and solid liquid separation stage be conducted in closed systems suitable for recovery of volatile halogen. The recovered halogen can be scrubbed and recycled to the agitation leach tank. For similar reasons it is considered more appropriate to add the reagent to the agitation leach tank rather than to the grinding mill.

The reagent provided by the invention may also be advantageously employed for in-situ leaching of subterranean deep lead gold deposits. The general technique of such treatments using aqueous cyanide solution for gold is already established. The reagent provided by the present invention may be advantageously employed in such applications due firstly to the rapid dissolution time compared with aqueous cyanide solution and secondly to the fact that cation and halogen sources may be selected such that the by-products are environmentally compatible and non-toxic in a dilute form should they escape into water courses or the like.

The reagent provided by the invention may also be advantageously employed for the flooded heap leaching of suitable ores. The rate of evaporation of reagent or components thereof may be retarded by at least partially covering the flooded area. Such covering may be effected by floating a barrier on the surface of the leach solution. A sheet of plastics material which remains substantially inert when in contact with the leach solution forms a suitable barrier. A test conducted on a "Nevoria" ore from Western Australia indicated that using a reagent according to the present invention recovery of approximately 90% of the gold present can be achieved via the flooded heap leaching method within 1 day or even less at higher reagent concentrations. This contrasts with an average treatment time of around six months for a similar recovery using an aqueous cyanide leachant. In the test concerned it was found convenient to pass the pregnant gold bearing leach solution (which retained an excess of unexpended reagent) through a carbon column to recover the gold from the solution whereupon the solution was cycled through a fresh ore heap to extract the gold therefrom.

The reagent provided by the invention may also be advantageously employed for the quantitative analysis of gold containing materials. Hitherto such analysis was typically conducted on samples of approximately 50 grams of total material by aqua regia dissolution or fire assay techniques. The present invention may be conveniently used for the analysis of much larger samples.

In a typical and preferred example of a quantitative analysis technique according to the present invention a gold containing sample having a total weight of 10 Kg. may be sealed in a vessel such as a cylinder of PVC together with an excess of reagent according to the invention. The contents of the vessel may be mixed such as by rotation of a cylindrical vessel at low speed e.g. about 40 r.p.m. for a period sufficient for complete dissolution of all gold present e.g. about one hour. After sufficient mixing to allow complete dissolution of all gold present, an adsorption medium such as activated carbon may be added to the vessel. The mixing is continued for a period sufficient for complete adsorption of all gold present e.g. about 15 minutes.

The contents of the vessel may then undergo solid/-liquid separation such as by passing the contents over a sieve of a size suitable to retain the solid phase comprising the adsorption medium. The solid adsorption medium may then be washed and ignited. The ignited residue which contains the extracted gold may be taken up into a measured quantity e.g. about 10 c.c. of liquid, preferably a reagent according to the invention. The concentration of gold in the liquid may then be determined by known methods such as atomic adsorption determination.

The ability of the analysis technique provided by the invention to be applied to a large sample enables the sample to be more representative of an ore body. Further the detection limit according to the present invention is 0.0001 ppm compared with a limit for the aqua regia method of 0.1 ppm using atomic absorption. Additional features of the analysis technique provided according to the present invention are that the test solution obtained is substantially free of interfering salts. The cost of the reagent is substantially less than for other methods and the technique can be conveniently carried out at least partially in the field using makeshift or mobile laboratory facilities.

Sea water or brackish (brine) water are often the only available sources of water close to a mine site. Neither source is suitable for cyanidation however both can be advantageously employed in accordance with the present invention.

To facilitate the further understanding of the invention it is convenient to now provide a number of Examples which demonstrate preferred embodiments thereof. It is to be appreciated, however, that the particularity of the Examples is not to be construed as limiting the scope of the invention.

EXAMPLES 1–42

A series of tests of dissolution rate was conducted using various reagents to determine the rate at which the reagents dissolve 999 fine gold strip. These tests involved weighing a sample of gold strip having a surface area of 1 $cm^2$ and suspending the strip so as to be fully immersed in the reagent for one hour. During immersion of the gold strip the vessel and its contents were rotated at a constant 40 r.p.m. The gold strip was then removed from the reagent, washed, dried and re-weighed to determine the weight loss.

Examples 1 and 10 are comparative tests in which the reagent contains a halogen source in the absence of a cation source. Examples 2–9 and 11–42 includes are examples of the use of a reagent according to the invention together with other reagents in which the pH has been unadjusted The results of the test series are summarised in Table A.

To facilitate the further understanding of the invention it is convenient to now provide a number of Examples which demonstrate preferred embodiments thereof. It is to be appreciated, however, that the particularity of the Examples is not to be construed as limiting the scope of the invention.

EXAMPLES 1–42

A series of tests of dissolution rate was conducted using various reagents to determine the rate at which the reagents dissolve 999 fine gold strip. These tests involved weighing a sample of gold strip having a surface area of 1 $cm^2$ and suspending the strip so as to be fully immersed in the reagent for one hour. During immersion of the gold strip the vessel and its contents were rotated at a constant 40 r.p.m. The gold strip was then removed from the reagent, washed, dried and re-weighed to determine the weight loss.

Examples 1 and 10 are comparative tests in which the reagent contains a halogen source in the absence of a cation source. Examples 2–9 and 11–42 inclusive are examples of the use of a reagent according to the invention. The results of the test series are summarised in Table A.

TABLE A

GOLD DISSOLUTION RATES IN AQUEOUS SOLUTION

| EXAMPLE NO. | HALOGEN SOURCE | CATION SOURCE | pH | DISSOLUTION RATE ($mg/cm^2/hr$) | SOLUTION TEMP. (°C.) |
|---|---|---|---|---|---|
| 1 | 0.1% v/v Br | — | 2.8 | 0.7 | 17 |
| 2 | " | 1% w/v NaCl | 3.15 | 6 | 17 |
| 3 | " | 1% w/v NaCl<br>0.07% w/v NaOH | 7.3 | 4.3 | 17 |
| 4 | " | 2.5% w/v NaCl | 3.45 | 12.4 | 17 |
| 5 | " | 2.5% w/v NaCl<br>0.07% w/v NaOH | 7.3 | 4.3 | 17 |
| 6 | " | 5.0% w/v NaCl | 3.6 | 18.6 | 17 |
| 7 | " | 5.0% w/v NaCl<br>0.07% w/v NaOH | 7.4 | 4.8 | 17 |
| 8 | " | 10.0% w/v NaCl | 3.8 | 22.8 | 17 |
| 9 | " | 10.0% w/v NaCl<br>0.07% w/v NaOH | 7.3 | 4.8 | 17 |
| 10 | 1.0% v/v Br | — | 2.8 | 6.3 | 16 |
| 11 | " | 1% w/v NaCl | 3.15 | 188 | 17 |
| 12 | 1.0% v/v Br | 1% w/v NaCl<br>1.0% w/v NaOH | 7.56 | 117 | 17 |
| 13 | " | 2.5% w/v NaCl | 3.3 | 198 | 17 |
| 14 | " | 2.5% w/v NaCl<br>1.0% w/v NaOH | 7.5 | 111 | 17 |
| 15 | " | 5.0% w/v NaCl | 3.35 | 247 | 17 |
| 16 | " | 5.0% w/v NaCl<br>1.0% w/v NaOH | 7.4 | 126 | 17 |
| 17 | " | 10.0% w/v NaCl | 3.4 | 256 | 17 |
| 18 | " | 10.0% w/v NaCl<br>1.0% w/v NaOH | 7.4 | 140 | 17 |
| 19 | " | 0.8% w/v NaOH | 7.5 | 158 | 16 |

TABLE A-continued

| GOLD DISSOLUTION RATES IN AQUEOUS SOLUTION | | | | | |
|---|---|---|---|---|---|
| EXAMPLE NO. | HALOGEN SOURCE | CATION SOURCE | pH | DISSOLUTION RATE ($mg/cm^2/hr$) | SOLUTION TEMP. (°C.) |
| 20 | " | 1% $NH_4Cl$ w/v | 1.6 | 220 | 16 |
| 21 | " | 1% $Na_2O_2$ v/v | 7.1 | 129 | 16 |
| 22 | " | 1% $Na_2O_2$ v/v (elapsed time 5 hrs.) | 7.15 | 92.4 | 16 |
| 23 | " | 1% $Na_2O_2$ v/v 0.05% NaOH w/v | 7.4 | 110 | 16 |
| 24 | " | 1% $KMnO_4$ w/v | 2.8 | 10.6 | 16 |
| 25 | " | 1% NaCl w/v 1% $KMnO_4$ w/v | 3.15 | 140.6 | 16 |
| 26 | " | 1% NaCl w/v 1% $KMnO_4$ w/v 0.8% w/v NaOH | 7.4 | 162 | 16 |
| 27 | 1.0% v/v Br | 1% w/v NaBr | 3.35 | 250 | 16 |
| 28 | " | 1% w/v NaBr 0.6% w/v NaOH | 7.35 | 207.4 | 16 |
| 29 | " | 1% w/v $ZnBr_2$ | 4.8 | 163.6 | 13 |
| 30 | " | 1% w/v $K_2CrO_4$ | 5.6 | 91.7 | 13 |
| 31 | " | 1% w/v $Li_2B_4O_7$ | 6.55 | 130.6 | 13 |
| 32 | " | 1% w/v $FeSO_4.7H_2O$ | 2.10 | 71.2 | 13 |
| 33 | " | 1% w/v $Fe_2(SO_4)_3.9H_2O$ | 2.0 | 5.0 | 13 |
| 34 | " | 1% w/v $NH_4I$ | 6.93 | 134.2 | 20 |
| 35 | " | 1% w/v $NH_4NO_3$ | 6.83 | 143.8 | 20 |
| 36 | " | 1% w/v $(NH_4)_2HPO_4$ | 7.82 | 176.7 | 20 |
| 37 | " | 1% w/v $(NH_4)_2SO_4$ | 6.87 | 174.6 | 20 |
| 38 | " | 1% w/v $NH_4.Cl$ | 6.76 | 152.0 | 20 |
| 39 | " | 1.2% w/v NaCl | 3.6 | 92.4 | 20 |
| 40 | " | 1.2% w/v NaCl | 3.1 | 272.0 | 45 (start) 33 (finish - hr.) |
| 41 | 1.0% v/v Br | 1.2% w/v NaOH | 7.8 | 81.2 | 20 |
| 42 | " | 1.2% w/v NaOH | 7.2 | 131.2 | 45 (start) 33 (finish - 1 hr) |

The results shown in Table A may be compared with published values for gold dissolution in aqueous cyanide and Aqua Regia as shown in Table B and the halogen corrosion rates for gold shown in Table C.

TABLE B

| Aqueous Cyanide | Concentration | Temp. °C. | $mg/cm^2/hr$* |
|---|---|---|---|
| Aqua Regia | 0.1% NaCN + air | 25 | 2.36 |
| | 0.1% NaCN + 99.5% $O_2$ | 25 | 12.63 |
| | 10% aq. soln. | Room | 0.03 |
| | concentrated | Room | 54.0 |

*Source - Gold Recovery, Properties & Applications Edited by E. M. Wise: D. Van Nostrand Company, Inc. Princeton, New Jersey.

TABLE C

| | Concentration | Temp. °C. | $mg/cm^2/hr$* |
|---|---|---|---|
| Chlorine: | Dry gas | 270 | 26.7 |
| | Dry gas | Room | 0.003 |
| | Moist gas | Room | 0.36 |
| | Sat. soln. in $H_2O$ | Room | 0.63 |
| Bromine: | Dry liquid | Room | 0.74 |
| | Moist liquid | Room | 0.28 |
| | Sat. Soln. in $H_2O$ | — | 0.73 |

TABLE C-continued

| | Concentration | Temp. °C. | $mg/cm^2/hr$* |
|---|---|---|---|
| Iodine: | Moist liquid | Room | Nil |

*Source - Corrosion Handbook Ed. H. Uhliq John Wiley & Sons Inc. New York, N.Y.
Soln. vols. 25 ml.
Specimen area 12.9 $cm^2$
Aeration by natural convection.

EXAMPLE 43

In this Example a sample of ore from the Telfer Gold Mine in North-West Australia was used to test the recovery of gold to solution using a reagent according to the invention.

The sample was assayed as containing 9.8 ppm of gold.

The reagent was prepared by first preparing a saline solution to which liquid bromine was added. The resultant reagent comprised an aqueous solution containing 10% w/v NaCl and 0.4% v/v bromine. The brominated solution was at the ambient temperature of 16° C. and its pH was 1.4.

A sample of ore was placed on a glass reaction vessel and sufficient prepared reagent added to produce a 50 wt. % solids content. The vessel was sealed and shaken to facilitate uniform wetting of the solids. The bottle and contents were rotated during the test and samples of pulp drawn off after reaction times of 5, 20 and 30 minutes. Each sample was filtered and the clear filtrate subjected to assay by Atomic Absorption with the following results.

| Recovery to Solution | Reaction Time 5 min. | 20 min. | 30 min. |
|---|---|---|---|
| p.p.m. Au | 6.0 | 8.0 | 9.4 |
| % | 61 | 82 | 96 |

The results tabulated above show that after only 30 minutes reaction time 96% of the gold in the ore sample was recovered to solution by use of a reagent according to the invention.

This result is in contrast to the results of a cyanide bottle test carried out on the same ore which indicates that a reaction time of approximately 24 hours is required in order to obtain a comparable percentage recovery.

EXAMPLE 44

A different sample of ore from the Telfer Gold Mine was used to test the selectivity of the reagent with respect to base metals. The particular sample used was obtained from an area adjacent to a supergene zone at the Telfer Mine, where base metal enrichment of the gold ore was known to occur. The sample was assayed as containing 4.1 ppm gold and 450 ppm copper. The ore sample as tested had the following size distribution:

| Mesh | Microns | Wt. % |
|---|---|---|
| +35 | 500 | 12.4 |
| 60 | 250 | 14.7 |
| 120 | 125 | 8.5 |
| 170 | 88 | 4.7 |
| −170 | −88 | 59.7 |

The reagent was prepared by first preparing a saline solution to which liquid bromine was added. The resultant reagent comprised an aqueous solution containing 10% w/v NaCl and 0.4% v/v of bromine. The brominated solution was at the ambient temperature of 15° C. and its pH was 1.3.

A 2000 g sample of the ore sample was placed in a cylindrical P.V.C. reaction vessel and the prepared reagent solution added to produce a slurry containing 50% solids by weight. The vessel was sealed and rotated at 40 r.p.m. Samples of the slurry were withdrawn after reaction times of 15, 30 and 60 minutes. Each sample was filtered and the clear filtrate assayed by Atomic Absorption with the following results:

| Recovery to Solution | Reaction Time 15 min. | 30 min. | 60 min. |
|---|---|---|---|
| ppm Au | 3.6 | 3.6 | 3.6 |
| % of total Au in sample | 87.8 | 87.8 | 87.8 |

The results tabulated above show that after only 15 minutes reaction time 87.8% of the gold in the ore sample was recovered to solution by use of the reagent according to the invention.

This result is in contrast to the time required for comparable recovery using a combination of laboratory gravity separation by jigging followed by cyanidation of the jig tailing for 24 hours, as tabulated below.

| | |
|---|---|
| Gold recovery to jig concentrate | 43.2% |
| Gold recovery by cyanidation of jig tailing | 44.9% |
| Overall Gold Recovery | 88.1% |

Cyanidation Conditions:
Cyanide Solution: 0.05% w/v
Lime Level: 0.03% w/v
Cyanide Consumption: 0.9 kg/tonne
Leach Time: 24 Hours.

A sub sample of the ore was boiled in concentrated aqua regia for one hour. The sample was filtered and the clear filtrate assayed by Atomic Absorption. The assay results are tabulated below and are compared against assays of the original ore sample and the solution obtained by dissolution of the ore sample using a reagent according to the invention:

| | Ore Sample | Solution obtained by dissolution in boiling Aqua Regia | Solution obtained by dissoln. in 10% NaCl w/w + 0.4% Br w/v |
|---|---|---|---|
| Au ppm | 4.1 | 3.7 | 3.6 |
| $Fe_2O_3$ % | 3.0 | 1.7 | .008 |
| MnO % | .005 | .0045 | .005 |
| CaO % | .26 | .0124 | .006 |
| Ni ppm | 5 | 4.2 | 0.6 |
| Pb ppm | 10 | 10.0 | 0.1 |
| Zn ppm | 3 | 2.4 | 0.1 |
| Cu ppm | 450 | 300 | 5 |

The tabulated results above show that base metal levels in the solution obtained, using a reagent according to the invention, are at very low levels and demonstrate selective dissolution of the gold.

EXAMPLE 45

A sample of an oxide ore from the Paddington Gold Mine was used to test the ability of the reagent provided by the invention to extract gold from coarse crushed ores. A first portion of the sample was crushed to pass through a 75 mesh screen and a second portion was treated in the form of coarse material not subjected to crushing.

Both portions were assayed and then treated with a reagent comprising an aqueous solution containing 0.4% v/v bromine and 0.4 percent w/v sodium hydroxide. The reagent was used at the ambient temperature of 16° C. and had a pH of 7.4.

Each portion of the ore sample was separately placed in a cylindrical P.V.C. reaction vessel and the prepared reagent solution added to produce a slurry containing approximately 50% solids by weight. The vessel was sealed and rotated at 40 r.p.m. for 60 minutes. Samples of the slurry were then withdrawn and filtered and the clear filtrate assayed by atomic absorption. In both cases 100% of the assayed gold in the ore sample was recovered to solution by use of the reagent according to the invention even though the ore had not been crushed in the case of the second portion. Thus, for this particular ore use of a reagent according to the invention can provide a substantial cost saving in that the cost of crushing the ore before recovering the gold is avoided.

EXAMPLE 46

Using the method of Examples 1 to 42 a test was conducted to determine the rate at which a reagent according to the invention which included a mixture of protic solvents would dissolve 999 fine gold strip.

The reagent employed comprised:

liquid bromine: 1.0% v/v sodium chloride: 1.0% w/v water/ethanol (10:1 parts by volume): balance This test was conducted at 15.5° C. and at a pH of 1.3 yielded a dissolution rate of 150 mg/cm$^2$/hr.

It is to be appreciated that the speed of dissolution can be affected significantly by various physical factors such as temperature, pH, freshness of reagents and purity of the gold so that the dissolution rates reported in the various examples are not always directly comparable one with the other.

However, a number of general observations can be made. Firstly it is noted that all of the results show a dissolution rate many times the rates given in Table B for aqueous aqua regia and aqueous cyanide. Secondly the addition of a source of cations to an aqueous solution of the halogen source substantially increases the rate of dissolution.

Finally, it is to be understood that various other modifications and/or alterations may be made without departing from the spirit of the present invention as defined in the following claims.

What is claimed is:

1. A process of dissolving metallic gold or removing metallic gold from a gold-containing material comprising the steps of:

(a) contacting metallic gold or a gold-containing material with an aqueous bromine-based composition comprising:

at least one source of cations, which source is able to highly dissociate in the solution, said source being a strong base or producing in solution at least one cation selected from the group consisting of sodium, potassium, ammonium, ferric and lithium ions; a halogen source capable of liberating an effective amount of bromine in a concentration of not more than 5 wt %; and sufficient acid or base such that the pH of the composition in contact with said gold is in the range of 5.6 to 8.5, to dissolve the gold in the aqueous composition; and (b) recovering the dissolved gold from the aqueous composition.

2. A process of dissolving metallic gold or removing metallic gold from a gold-containing material comprising the steps of:

(a) contacting metallic gold or a gold-containing material with an aqueous bromine-based composition comprising:

at least one source of cations, which source is able to highly dissociate in the solution, said source being a strong base or producing in solution at least one cation selected from the group consisting of sodium, potassium, ammonium, ferric and lithium ions;

a bromine containing substance selected from the group consisting of bromine in a concentration of not more than 5 wt %; and sufficient acid or base such that the pH of the composition in contact with said gold is in the range of 5.6 to 8.5, to dissolve the gold in the aqueous composition; and (b) recovering the dissolved gold from the aqueous composition.

3. A process of dissolving metallic gold or removing metallic gold from the gold-containing material comprising the steps of:

(a) contacting metallic gold or a gold-containing material with an aqueous bromine-based composition comprising: at least one source of cations, which source is able to highly dissociate in the solution, said source being a strong base or producing in solution at least one cation selected from the group consisting of sodium, potassium, ammonium, ferric and lithium ions;

a bromine containing compound, which together with an oxidizing agent is capable of liberating an effective amount of bromine in a concentration of not more than 5 wt %; and sufficient acid or base such that the pH of the composition in contact with said gold is in the range of 5.6 to 8.5, to dissolve the gold in the aqueous composition; and (b) recovering the dissolved gold from the aqueous composition.

4. In a method of extracting metallic gold from a gold-containing material by contacting a gold-containing material with a bromine-based gold leaching solution with water, ethanol, methanol or mixtures thereof as a solvent and thereby leaching the gold from the gold-containing material, the improvement wherein the gold leaching solution comprises in solution:

(a) at least one source of cations, which source is able to highly dissociate in the solution, said source being a strong base or producing in solution at least one cation selected from the group consisting of sodium, potassium, ammonium, ferric and lithium ions;

(b) a halogen source capable of liberating an effective amount of bromine in a concentration of not more than 5 wt %; and (c) sufficient acid or base such that the pH of the composition in contact with said gold is in the range of 4.8 to 8.5.

5. A method as in claim 1 wherein the solvent is water, and the halogen source is selected from the group consisting of bromine, bromine liquid, bromine water or a bromine containing compound.

6. A method as in claim 5 wherein the gold containing material is an ore.

7. A method as in claim 5 wherein the gold containing material is metallic gold.

8. A method as in claims 6 or 7 wherein the pH of the composition is not less than 5.6.

9. A method as in claims 6 or 7 wherein the pH of the composition is in the range of from 6.5 to 7.5.

10. A method as in claim 9 the composition further including an anion selected from the group consisting of bromide and chloride ions.

11. A method as in claim 9 wherein the base and the cation source is sodium hydroxide.

12. A method as in claim 5 wherein gold dissolved by the composition is recovered by solvent extraction.

13. A method as in claim 5 wherein gold dissolved by the composition is recovered by electro-deposition.

14. A method as in claim 5 wherein gold dissolved by the composition is recovered by carbon absorption.

15. A method as in claim 5 wherein gold dissolved by the composition is recovered by ion exchange.

16. A method as in claim 6 wherein said method comprises the additional steps of separating the composition from said ore and recovering the gold from said composition.

17. A method as in claim 6 wherein said composition is agitated with said ore for a period of less than two hours.

18. A method as in claim 6 wherein said ore is in a subterranean deep lead and leaching is performed according to the in-situ leaching method.

19. A method as in claim 6 wherein said leaching of the ore is performed according to the flood heap leaching method.

* * * * *

REEXAMINATION CERTIFICATE (909th)

United States Patent [19]

Kalocsai

[11] B1 4,684,404

[45] Certificate Issued Aug. 9, 1988

[54] DISSOLUTION OF NOBLE METALS

[75] Inventor: Guy I. Z. Kalocsai, Armidale, Australia

[73] Assignee: Kaljas Pty. Limited, North Sydney, Australia

Reexamination Request:
No. 90/001,385, Dec. 1, 1987

Reexamination Certificate for:

| | |
|---|---|
| Patent No.: | **4,684,404** |
| Issued: | **Aug. 4, 1987** |
| Appl. No.: | **784,463** |
| Filed: | **Oct. 4, 1985** |

Related U.S. Application Data

[63] Continuation of Ser. No. 628,371, Jul. 6, 1984, abandoned.

[30] Foreign Application Priority Data

Jul. 8, 1983 [AU] Australia ..... PG0202

[51] Int. Cl.[4] ..... C01G 7/00; C22B 11/04

[52] U.S. Cl. ..... 75/118 R; 252/187.2; 423/38; 423/80; 436/26

[58] Field of Search ..... 75/118 R; 436/80, 177, 436/178, 26; 252/186.1, 186.43, 187.1, 187.2, 182; 423/38

[56] References Cited

U.S. PATENT DOCUMENTS

| | | | |
|---|---|---|---|
| 267,723 | 11/1882 | Schaeffer . | |
| 716,847 | 12/1902 | Martino | 423/38 X |
| 732,709 | 7/1903 | Cassel | 423/38 X |
| 861,535 | 7/1907 | Pritchard . | |
| 1,041,407 | 10/1912 | Baxeres | 423/38 |
| 2,283,198 | 5/1942 | Fink et al. . | |
| 2,304,823 | 12/1942 | Harrison . | |
| 2,457,480 | 12/1948 | Lewis | 252/187.2 X |
| 3,397,040 | 8/1968 | Lakin et al. . | |
| 3,495,976 | 2/1970 | Bazilevsky et al. | 423/38 X |
| 3,547,573 | 12/1970 | Tourdot et al. | 252/187.2 X |
| 3,558,503 | 1/1971 | Goodenough et al. | 252/187.2 |
| 3,625,674 | 12/1971 | Jacobs . | |
| 3,709,681 | 1/1973 | Wilson . | |
| 3,764,650 | 10/1973 | Scheiner et al. | 423/38 |
| 3,778,252 | 12/1973 | Wilson . | |
| 3,886,081 | 5/1975 | Ceska | 252/187.2 X |
| 3,957,505 | 5/1976 | Homick et al. | 423/38 X |
| 4,190,489 | 2/1980 | Bahl et al. | 423/38 X |
| 4,260,451 | 4/1981 | Schmeckenbecher | 423/38 X |
| 4,375,984 | 3/1983 | Bahl et al. . | |
| 4,382,799 | 5/1983 | Davis et al. | 252/187.2 X |
| 4,389,248 | 6/1983 | Iio et al. . | |
| 4,397,690 | 8/1983 | Vanderpool et al. | 423/38 X |

FOREIGN PATENT DOCUMENTS

| | | | |
|---|---|---|---|
| 22102/25 | of 1925 | Australia . | |
| 85570 | of 1895 | Fed. Rep. of Germany . | |
| 50-1072 | of 1975 | Japan . | |
| 11817 | of 1886 | United Kingdom . | |
| 696036 | 11/1979 | U.S.S.R. | 252/187.2 |

OTHER PUBLICATIONS

J. W. Mellor "A Comprehensive Treatise on Inorganic and Theoretical Chemistry", vol. 2, 83-85 (1927).

Chemical Abstracts 93:106422Z, Meier, A. L., J. Geochem. Explor. 13 (1) 77-85 (1980).

Kirk-Othmer Encyclopedia of Chemical Technology 2nd Ed., vol. 3, 753,757 John Wiley & Sons (1964).

Radlick, P. et al, Synthesis 290-292 (1974).

Wallis, E. S. et al, Journal American Chemical Society, 55, 2598-2683 (1933).

Whitmore, F. C. et al, Journal American Chemical Society, 54, 3435-3437 (1932).

Kakovskii, I. A. et al, Isz. Akad. Nauk SSSR, Met., Jan.-Feb. 1978 (1).

Peshchevitsky, B. I. et al, Journal of Inorganic Chemistry, 14, 2393-2396 (1969) and English translation thereof.

Haddon, M. J. et al, Analyst, 105, 371-378 (1980).

Cudey, G. et al, Thermochimica Acta, 67, 1-15 (1983) and English translation thereof.

Wise, E. W. (Ed.) Gold, Recovery, Properties and Applications, Van Nostrand Co. Inc., Princeton, NJ (1964) p. 49.

McGraw-Hill Encyclopedia of Science & Technology, (1982), vol. 12, p. 155.

"Chlorine as a Solvent in Gold Hydrometallurgy", G. Putnam, 145(3) 70-73 (1944) Engineering and Mining Journal.

Nickles (1867) Ann. Ch. Phys. [4], pp. 318, 323 and English translation.

Godshall L. D. (1894) Engineering & Mining Journal, Jan. 6, Jan. 13, pp. 5-7 and pp. 32-33.

Rose, T. Kirke (1906) The Metallurgy of Gold, 5th edition, Charles Griffin and Co. Ltd., London, pp. 16-29, 266-317.

Louw, W. J. & Robb, W., Inorganica Chimica Acta 9 33-37 (1974).

Pauli, H. Berg-und Huettenmaennische Zeitung 56 (44) 379-380 (1897) original German text and translation.

Dingler's Polytechisches Journal, 1875, p. 253, original German text and translation.

Schnabel, K., Handbook of Metallurgy (translated by Henry Louis), vol. I, Copper-Lead-Silver-Gold, 2nd ed., 1007-1009 (1905) pub. by Macmillan & Co. Ltd.

Schnabel, K., Handbook of Metallurgy (translated by Henry Louis), vol. 1, Copper-Lead-Silver-Gold, 827 (1896) pub. by Macmillan & Co. Ltd., London.

*Primary Examiner*—Michael S. Marcus

[57] ABSTRACT

The invention provides a reagent suitable for the dissolution of metallic gold and various methods for the application of the reagent including gold analysis, gold extraction, gold separation and the in-situ treatment of gold deposits.

The reagent uses a protic solvent containing a preferably non-reducing cation source and a source of bromine optionally in combination with a strong oxidizing agent. The protic solvent is water or a lower alkyl alcohol or a mixture thereof. The cation source preferably highly dissociates in the protic solvent and suitable cation sources include dibasic ammonium phosphate, ammonium sulphate, potassium chromate, hydrochloric acid, sodium hydroxide and potassium hydroxide. Cation sources which liberate ammonium cations are preferred.

The strong oxidizing agent should by highly dissociated in the solvent and is preferably selected from the group consisting of hydrogen peroxide, sodium peroxide, potassium peroxide, sodium permanganate, potassium permanganate, potassium dichromate and ferric sulphate.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 4 is confirmed.

Claims 2, 3 and 5 are determined to be patentable as amended.

Claims 6–19, dependent on an amended claim, are determined to be patentable.

New claims 20–22 are added and determined to be patentable.

2. A process of dissolving metallic gold or removing metallic gold from a gold-containing material comprising the steps of:

(a) contacting metallic gold or a gold-containing material with an aqueous bromine-based composition comprising:

at least one source of cations, which source is able to highly dissociate in the solution, said source being a strong base or producing in solution at least one cation selected from the group consisting of sodium, potassium, ammonium, ferric and lithium ions;

a bromine containing substance selected from the group consisting of bromine *gas, bromine liquid and bromine water, said substance being capable of liberating an effective amount of bromine* in a concentration of not more than 5 wt %; and sufficient acid or base such that the pH of the composition in contact with said gold is in the range of 5.6 to 8.5, to dissolve the gold in the aqueous composition; and (b) recovering the dissolved gold from the aqueous composition.

3. A process of dissolving metallic gold or removing metallic gold from [the] *a* gold-containing material comprising the steps of:

(a) contacting metallic gold or a gold-containing material with an aqueous bromine-based composition comprising: at least one source of cations, which source is able to highly dissociate in the solution, said source being a strong base or producing in solution at least one cation selected from the group consisting of sodium, potassium, ammonium, ferric and lithium ions;

a bromine containing compound, which together with an oxiding agent is capable of liberating an effective amount of bromine in a concentration of not more than 5 wt %; and sufficient acid or base such that the pH of the composition in contact with said gold is in the range of 5.6 to 8.5, to dissolve the gold in the aqueous composition; and (b) recovering the dissolved gold from the aqueous composition.

5. A method as claimed in claim [1] *4* wherein the solvent is water, and the halogen source is selected from the groups consisting of bromine gas, bromine liquid, bromine water or a bromine containing compound.

*20. A method as in claim 6 wherein the bromine containing compound is an organic bromine containing compound.*

*21. A method as in claim 3 wherein the pH of the composition is in the range of from 6.5 to 7.5.*

*22. A method as in claim 5 wherein the bromine containing compound acts as a strong oxidizing agent.*

* * * * *